US010001122B2

(12) United States Patent
Uekawa

(10) Patent No.: US 10,001,122 B2
(45) Date of Patent: Jun. 19, 2018

(54) SCROLL COMPRESSOR

(71) Applicant: DAIKIN INDUSTRIES, LTD., Osaka-shi, Osaka (JP)

(72) Inventor: Takashi Uekawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 235 days.

(21) Appl. No.: 14/348,480

(22) PCT Filed: Sep. 27, 2012

(86) PCT No.: PCT/JP2012/006192
§ 371 (c)(1),
(2) Date: Mar. 28, 2014

(87) PCT Pub. No.: WO2013/046694
PCT Pub. Date: Apr. 4, 2013

(65) Prior Publication Data

US 2014/0227117 A1 Aug. 14, 2014

(30) Foreign Application Priority Data

Sep. 30, 2011 (JP) ..... 2011-218357

(51) Int. Cl.
*F04C 29/00* (2006.01)
*F04C 23/00* (2006.01)
*F04C 18/02* (2006.01)

(52) U.S. Cl.
CPC ..... *F04C 29/0021* (2013.01); *F04C 18/0215* (2013.01); *F04C 23/008* (2013.01); *F04C 2230/605* (2013.01); *F04C 2240/601* (2013.01)

(58) Field of Classification Search
CPC ..... F04C 18/0215; F04C 23/008; F04C 29/0021; F04C 2230/605; F04C 2240/601;
(Continued)

(56) References Cited

U.S. PATENT DOCUMENTS 2,817,980 A * 12/1957 Eberhard ..... F16C 3/20 74/603
4,768,936 A * 9/1988 Etemad ..... F04C 23/008 184/6.2
(Continued)

FOREIGN PATENT DOCUMENTS

EP 1 698 784 A1 9/2006
JP 62-118002 A 5/1987
(Continued)

OTHER PUBLICATIONS

International Preliminary Report of corresponding PCT Application No. PCT/JP2012/006192 dated Apr. 10, 2014.
(Continued)

*Primary Examiner* — Dominick L Plakkoottam
*Assistant Examiner* — Philip Stimpert
(74) *Attorney, Agent, or Firm* — Global IP Counselors, LLP

(57) ABSTRACT

A scroll compressor includes a compression mechanism, a crankshaft, upper and lower bearings, and a drive motor. The compression mechanism includes fixed and movable scrolls engaged with each other to form a compression chamber. The crankshaft has a main shaft and an eccentric portion eccentrically disposed at one end of the main shaft and coupled to a back side of the movable scroll. The upper and lower bearings support upper and lower portions of the main shaft. The drive motor has a stator and a rotor coupled to the main shaft to rotate the movable scroll. At least one of the main shaft and the rotor is provided with a weight arranged to reduce distortion of the crankshaft caused by a fluid load generated in the compression chamber and applied to the eccentric portion during rotation.

9 Claims, 8 Drawing Sheets

(58) Field of Classification Search
CPC ..... F15F 15/32; F15F 15/322; F15F 15/28; F15F 15/283; F16C 3/20
USPC ..... 74/603–604
See application file for complete search history.

(56) References Cited

U.S. PATENT DOCUMENTS 5,222,881 A * 6/1993 Sano ..... F01C 21/02 384/192
5,503,539 A * 4/1996 Nakajima ..... F04C 18/0215 418/55.1
6,190,147 B1 * 2/2001 Kimbara ..... F01C 17/06 418/151
2003/0013534 A1 * 1/2003 Killion ..... F02B 75/20 464/180
2007/0231171 A1 10/2007 Tsuchiya et al.
2008/0247890 A1 * 10/2008 Kubota ..... F04B 39/0094 417/437

FOREIGN PATENT DOCUMENTS

JP 10-61569 A 3/1998
JP 2004-270654 A 9/2004

OTHER PUBLICATIONS

International Preliminary Report of corresponding PCT Application No. PCT/JP2012/006192.
International Search Report of corresponding PCT Application No. PCT/JP2012/006192.
European Search Report of corresponding EP Application No. '1 83 4813.3 dated Apr. 7, 2015.

* cited by examiner

FIG.5

CENTRIFUGAL FORCE OF WEIGHT DURING ROTATION

| | LOAD(kgf) |
|---|---|
| UPPER FLUID-INDUCED DISTORTION REDUCING WEIGHT (CENTRIFUGAL FORCE E) | 167 |
| MIDDLE FLUID-INDUCED DISTORTION REDUCING WEIGHT (CENTRIFUGAL FORCE F) | 334 |
| LOWER FLUID-INDUCED DISTORTION REDUCING WEIGHT (CENTRIFUGAL FORCE G) | 167 |
| FIRST BALANCING WEIGHT (CENTRIFUGAL FORCE H) | 1505 |
| SECOND BALANCING WEIGHT (CENTRIFUGAL FORCE I) | 853 |
| UPPER CENTRIFUGAL DISTORTION REDUCING WEIGHT (CENTRIFUGAL FORCE K) | 915 |
| MIDDLE CENTRIFUGAL DISTORTION REDUCING WEIGHT (CENTRIFUGAL FORCE L) | 1826 |
| LOWER CENTRIFUGAL DISTORTION REDUCING WEIGHT (CENTRIFUGAL FORCE M) | 911 |

FIG.7

CENTRIFUGAL FORCE AND GRAVITY CENTER DIRECTION OF WEIGHT DURING ROTATION

| | LOAD(kgf) | GRAVITY CENTER DIRECTION(deg) |
|---|---|---|
| UPPER WEIGHT (CENTRIFUGAL FORCE N) | 931 | 260 |
| MIDDLE WEIGHT (CENTRIFUGAL FORCE O) | 463 | 44 |
| LOWER WEIGHT (CENTRIFUGAL FORCE P) | 176 | 199 |

SCROLL COMPRESSOR

CROSS-REFERENCE TO RELATED APPLICATIONS

This U.S. National stage application claims priority under 35 U.S.C. § 119(a) to Japanese Patent Application No. 2011-218357, filed in Japan on Sep. 30, 2011, the entire contents of which are hereby incorporated herein by reference.

TECHNICAL FIELD

The present invention relates to scroll compressors, and specifically relates to reducing a reduction in bearing strength in the case where a fluid pressure is high.

BACKGROUND ART

Scroll compressors in which a fixed scroll and a movable scroll are engaged with each other, thereby forming a compression chamber, have been known. For example, Japanese Unexamined Patent Publication No. H10-61569 discloses a scroll compressor of this type. The scroll compressor includes a crankshaft having a main shaft and an eccentric portion that is eccentrically provided at one end of the main shaft, and a movable scroll is coupled to the eccentric portion of the crankshaft. When the crankshaft is rotated, the movable scroll is eccentrically rotated, allowing a low-pressure fluid to be sucked and compressed in a compression chamber and discharged to the outside as a high-pressure fluid.

SUMMARY

Technical Problem

In the conventional scroll compressor, a load (a fluid load) is applied to the eccentric portion by the fluid pressure in the compression chamber. The fluid load increases as the fluid pressure in the compression chamber increases. Thus, distortion of the crankshaft is increased when the fluid pressure is high, which increases abrasion of the bearing supporting the crankshaft and reduces the bearing strength.

The present invention is thus intended to reduce a reduction in bearing strength in the case where a fluid pressure is high.

Solution to the Problem

The first aspect of the present disclosure is intended for a scroll compressor, including: a compression mechanism (20) in which a fixed scroll (21) and a movable scroll (31) are engaged with each other, thereby providing a compression chamber (30) configured to compress a fluid; a crankshaft (40) having a main shaft (41) and an eccentric portion (42) eccentrically provided at one end of the main shaft (41) and coupled to a back side of the movable scroll (31); an upper bearing (63) supporting an upper portion of the main shaft (41) of the crankshaft (40); a lower bearing (71) supporting a lower portion of the main shaft (41) of the crankshaft (40); and a drive motor (50) having a stator (51) and a rotor (52) coupled to the main shaft (41) of the crankshaft (40), and configured to rotate the movable scroll (31). At least one of the main shaft (41) of the crankshaft (40) and the rotor (52) of the drive motor (50) is provided with a weight (80) which reduces distortion of the crankshaft (40) caused by a fluid load generated in the compression chamber (30) and applied to the eccentric portion (42) during rotation.

In the scroll compressor of the first aspect of the present disclosure, the upper portion of the main shaft (41) of the crankshaft (40) is supported by the upper bearing (63), and the lower portion of the main shaft (41) is supported by the lower bearing (71). Therefore, when a fluid load is applied to the eccentric portion (42) of the crankshaft (40), counterforce is applied to the upper and lower portions of the main shaft (41), forcing the crankshaft (40) to be deformed in the direction of the fluid load.

In the first aspect of the present disclosure, distortion of the crankshaft (40) in the direction of the fluid load during rotation is reduced by the centrifugal force of the weight (80) provided at least one of the main shaft (41) or the rotor (52). Thus, even when the fluid pressure is increased and therefore the fluid load is increased, an increase in distortion of the crankshaft (40) is prevented. As a result, excessively high contact pressure is prevented from being locally generated due to uneven contact of the crankshaft (40) with the bearings when the fluid pressure is high, thereby reducing abrasion of the bearings.

The second aspect of the present disclosure is that in the first aspect of the present disclosure, the weight (80) includes a fluid-induced distortion reducing weight (81, 82, 83) which reduces distortion of the crankshaft (40) in a direction of the fluid load. The fluid-induced distortion reducing weight (81, 82, 83) includes an upper fluid-induced distortion reducing weight (81) which is provided at an upper portion of the main shaft (41) and of which a center of gravity is located away from an axial center of the main shaft (41) in a direction opposite to the direction of the fluid load, a middle fluid-induced distortion reducing weight (82) which is provided at a middle portion of the main shaft (41) and of which a center of gravity is located away from the axial center of the main shaft (41) in a same direction as the direction of the fluid load, and a lower fluid-induced distortion reducing weight (83) which is provided at a lower portion of the main shaft (41) and of which center of gravity is located away from the axial center of the main shaft (41) in the direction opposite to the direction of the fluid load, and the upper fluid-induced distortion reducing weight (81), the middle fluid-induced distortion reducing weight (82), and the lower fluid-induced distortion reducing weight (83) are balanced with one another.

In the second aspect of the present disclosure, three fluid-induced distortion reducing weights (81, 82, 83) are provided as the weight (80). When the crankshaft (40) is rotated, the centrifugal force of the upper fluid-induced distortion reducing weight (81) is applied to the upper portion of the main shaft (41) in a direction opposite to the direction of the fluid load. Further, the centrifugal force of the middle fluid-induced distortion reducing weight (82) is applied to the middle portion of the main shaft (41) in the same direction as the direction of the fluid load, and the centrifugal force of the lower fluid-induced distortion reducing weight (83) is applied to the lower portion of the main shaft (41) in the direction opposite to the direction of the fluid load. The applying directions are opposite between the centrifugal force of the upper fluid-induced distortion reducing weight (81) and the fluid load applied to the eccentric portion (42), between the centrifugal force of the middle fluid-induced distortion reducing weight (82) and the counterforce of the upper portion of the main shaft (41), and between the centrifugal force of the lower fluid-induced distortion reducing weight (83) and the counterforce of the lower portion of the main shaft (41). This means that the centrifugal forces of the three fluid-induced distortion reducing weights (81, 82, 83) are applied such that distortion of the crankshaft (40) caused by the fluid load and its counterforce is reduced.

The third aspect of the present disclosure is that in the second aspect of the present disclosure, the weight (80) includes a balancing weight (91, 92) which balances a centrifugal force of the movable scroll (31) during rotation. The balancing weight (91, 92) includes a first balancing weight (91) of which a center of gravity is located opposite to the eccentric portion (42) relative to the axial center of the main shaft (41), and a second balancing weight (92) which is farther from the eccentric portion (42) than the first balancing weight (91) is, and of which a center of gravity is located on a same side where the eccentric portion (42) is positioned, relative to the axial center of the main shaft (41).

In the third aspect of the present disclosure, two balancing weights (91, 92) in addition to the three fluid-induced distortion reducing weights (81, 82, 83) are provided as the weight (80). When the crankshaft (40) is rotated, the centrifugal force of the first balancing weight (91) is generated in a direction opposite to the eccentric direction of the eccentric portion (42), and the centrifugal force of the second balancing weight (92) is generated in the same direction as the eccentric direction of the eccentric portion (42). When the two centrifugal forces are applied to the main shaft (41), a force opposite to the eccentric direction of the eccentric portion (42), that is, opposite to the centrifugal force of the movable scroll (31) is applied to the eccentric portion (42) to balance the centrifugal force of the movable scroll (31).

The fourth aspect of the present disclosure is that in the third aspect of the present disclosure, the weight (80) includes a centrifugal distortion reducing weight (101, 102, 103) which reduces distortion of the crankshaft (40) caused by balancing the centrifugal force of the movable scroll (31) with a centrifugal force of the balancing weight (91, 92). The centrifugal distortion reducing weight (101, 102, 103) includes an upper centrifugal distortion reducing weight (101) which is provided at an upper portion of the main shaft (41) and of which a center of gravity is located opposite to the eccentric portion (42) relative to the axial center of the main shaft (41), a middle centrifugal distortion reducing weight (102) which is provided at a middle portion of the main shaft (41) and of which a center of gravity is located on a same side where the eccentric portion (42) is positioned, relative to the axial center of the main shaft (41), and a lower centrifugal distortion reducing weight (103) which is provided at a lower portion of the main shaft (41) and of which a center of gravity is located opposite to the eccentric portion (42) relative to the axial center of the main shaft (41), and the upper centrifugal distortion reducing weight (101), the middle centrifugal distortion reducing weight (102), and the lower centrifugal distortion reducing weight (103) are balanced with one another.

In the fourth aspect of the present disclosure, three centrifugal distortion reducing weights (101, 102, 103) in addition to the three fluid-induced distortion reducing weights (81, 82, 83) and the two balancing weights (91, 92) are provided as the weight (80). When the crankshaft (40) is rotated, the centrifugal force of the upper centrifugal distortion reducing weight (101) is generated in the direction opposite to the eccentric direction of the eccentric portion (42). Further, the centrifugal force of the middle centrifugal distortion reducing weight (102) is generated in the same direction as the eccentric direction of the eccentric portion (42), and the centrifugal force of the lower centrifugal distortion reducing weight (103) is generated in the direction opposite to the eccentric direction of the eccentric portion (42). The applying directions are opposite between the centrifugal force of the upper centrifugal distortion reducing weight (101) and the centrifugal force of the movable scroll (31), between the centrifugal force of the middle centrifugal distortion reducing weight (102) and the centrifugal force of the first balancing weight (91), and between the centrifugal force of the lower centrifugal distortion reducing weight (103) and the centrifugal force of the second balancing weight (92). This means that the centrifugal forces of the three centrifugal distortion reducing weights (101, 102, 103) are applied such that distortion of the crankshaft (40) caused by the centrifugal forces of the movable scroll (31) and the two balancing weights (91, 92) is reduced.

The fifth aspect of the present disclosure is that in the fourth aspect of the present disclosure, at least one of the upper fluid-induced distortion reducing weight (81), the middle fluid-induced distortion reducing weight (82), or the lower fluid-induced distortion reducing weight (83) is integrally formed with any one of the first balancing weight (91), the second balancing weight (92), the upper centrifugal distortion reducing weight (101), the middle centrifugal distortion reducing weight (102) and the lower centrifugal distortion reducing weight (103).

In the fifth aspect of the present disclosure, it is possible to reduce the number of parts and assembly steps.

The sixth aspect of the present disclosure is that in the first aspect of the present disclosure, the weight (80) generates, during rotation, a first force, a second force, and a third force which reduce distortion of the crankshaft (40) in a direction of the fluid load and are balanced with one another, and a fourth force and a fifth force which balance the centrifugal force of the movable scroll (31), and a sixth force, a seventh force, and an eighth force which reduce distortion of the crankshaft (40) caused by balancing the centrifugal force of the movable scroll (31) with the fourth force and the fifth force and are balanced with one another. The weight (80) includes an upper weight (111) which is provided at an upper portion of the main shaft (41) and generates a total force of the first force and the sixth force as a centrifugal force thereof, a middle weight (112) which is provided at a middle portion of the main shaft (41) and generates a total force of the second force, the fourth force, and the seventh force as a centrifugal force thereof, and a lower weight (113) which is provided at a lower portion of the main shaft (41) and generates a total force of the third force, the fifth force, and the eighth force as a centrifugal force thereof.

In the sixth aspect of the present disclosure, the three weights (111, 112, 113) generate, during rotation, three forces which reduce distortion of the crankshaft (40) in the direction of the fluid load, two forces which balance the centrifugal force of the movable scroll (31), and three forces which reduce distortion of the crankshaft (40) in a direction of the centrifugal force of the movable scroll (31). This state is the same as the state in which the crankshaft (40) is rotated with three fluid-induced distortion reducing weights (81, 82, 83), two balancing weights (91, 92), and three centrifugal distortion reducing weights (101, 102, 103) provided at the main shaft (41). Thus, in the sixth aspect of the present disclosure, as well, a state is created in which the centrifugal force of the movable scroll (31) is balanced, and distortion of the crankshaft (40) in the direction of the fluid load is reduced and distortion of the crankshaft (40) in the direction of the centrifugal force of the movable scroll (31) is reduced.

The seventh aspect of the present disclosure is that in the first aspect of the present disclosure, the weight (80) generates, during rotation, a first force, a second force, and a third force which reduce distortion of the crankshaft (40) in a direction of the fluid load and are balanced with one another, and a fourth force and a fifth force which balance the centrifugal force of the movable scroll (31), and a sixth force, a seventh force, and an eighth force which reduce distortion of the crankshaft (40) caused by balancing the centrifugal force of the movable scroll (31) with the fourth force and the fifth force and are balanced with one another. The weight (80) includes an upper weight (111) which is provided at an upper portion of the main shaft (41) and generates a total force of the first force, the fourth force, and the sixth force as a centrifugal force thereof, a middle weight (112) which is provided at a middle portion of the main shaft (41) and generates a total force of the second force and the seventh force as a centrifugal force thereof, and a lower weight (113) which is provided at a lower portion of the main shaft (41) and generates a total force of the third force, the fifth force, and the eighth force as a centrifugal force thereof.

In the seventh aspect of the present disclosure, the three weights (111, 112, 113) generate, during rotation, three forces which reduce distortion of the crankshaft (40) in the direction of the fluid load, two forces which balance the centrifugal force of the movable scroll (31), and three forces which reduce distortion of the crankshaft (40) in the direction of the centrifugal force of the movable scroll (31). This state is the same as the state in which the crankshaft (40) is rotated with the three fluid-induced distortion reducing weights (81, 82, 83), two balancing weights (91, 92), and three centrifugal distortion reducing weights (101, 102, 103) provided at the main shaft (41). Thus, in the seventh aspect of the present disclosure, as well, a state is created in which the centrifugal force of the movable scroll (31) is balanced, and distortion of the crankshaft (40) in the direction of the fluid load is reduced and distortion of the crankshaft (40) in the direction of the centrifugal force of the movable scroll (31) is reduced.

Advantages of the Invention

According to the present invention, the weight (80) which reduces distortion of the crankshaft (40) in the direction of the fluid load caused by the fluid load applied to the eccentric portion (42) during rotation, is provided at least one of the main shaft (41) of the crankshaft (40) or the rotor (52) of the drive motor (50). Thus, it is possible to reduce an increase in distortion of the crankshaft (40) in the direction of the fluid load when the fluid pressure is high. As a result, abrasion of the bearings and a reduction in bearing strength due to the abrasion can be reduced, compared to the conventional cases.

According to the second aspect of the present disclosure, the upper fluid-induced distortion reducing weight (81), the middle fluid-induced distortion reducing weight (82), and the lower fluid-induced distortion reducing weight (83) are provided as the weight (80). Thus, distortion of the crankshaft (40) due to the fluid load can be reliably reduced.

According to the third aspect of the present disclosure, two balancing weights (91, 92) in addition to the three fluid-induced distortion reducing weights (81, 82, 83) are provided as the weight (80). Thus, the centrifugal force of the movable scroll (31) can be reliably balanced while reducing distortion of the crankshaft (40) due to the fluid load.

According to the fourth aspect of the present disclosure, three centrifugal distortion reducing weights (101, 102, 103) in addition to the three fluid-induced distortion reducing weights (81, 82, 83) and the two balancing weights (91, 92) are provided as the weight (80). Thus, distortion of the crankshaft (40) due to the fluid load can be reliably reduced, and the centrifugal force of the movable scroll (31) is balanced, thereby reducing distortion of the crankshaft (40) caused by the centrifugal forces of the movable scroll (31) and the balancing weights (91, 92).

According to the fifth aspect of the present disclosure, at least one of the three fluid-induced distortion reducing weights (81, 82, 83) is integrally formed with any one of the two balancing weights (91, 92) and the three centrifugal distortion reducing weights (101, 102, 103). Thus, it is possible to reduce the number of parts and assembly steps, thereby making it possible to reduce costs of the scroll compressor (1).

According to the sixth aspect of the present disclosure, the upper weight (111), the middle weight (112), and the lower weight (113) are provided as the weight (80) to generate, during rotation, three centrifugal forces which reduce distortion of the crankshaft (40) in the direction of the fluid load, two centrifugal forces which balance the centrifugal force of the movable scroll (31), and three centrifugal forces which reduce distortion of the crankshaft (40) in the direction of the centrifugal force of the movable scroll (31). This state is the same as the state in which the crankshaft (40) is rotated with the three fluid-induced distortion reducing weights (81, 82, 83), the two balancing weights (91, 92), and the three centrifugal distortion reducing weights (101, 102, 103) provided at the main shaft (41). Thus, in the sixth aspect of the present disclosure, as well, abrasion of the bearings can be reduced and a reduction in bearing strength can be reduced when the fluid pressure is high. Further, a total weight and a total volume of the weights can be smaller compared to the case in which the three fluid-induced distortion reducing weights (81, 82, 83), the two balancing weights (91, 92), and the three centrifugal distortion reducing weights (101, 102, 103) are provided, and therefore, it is possible to reduce the weight of the scroll compressor (1) and reduce space for locating the weights, thereby reducing the size of the scroll compressor (1).

According to the seventh aspect of the present disclosure, the upper weight (111), the middle weight (112), and the lower weight (113) are provided as the weight (80) to generate, during rotation, three centrifugal forces which reduce distortion of the crankshaft (40) in the direction of the fluid load, two centrifugal forces which balance the centrifugal force of the movable scroll (31), and three centrifugal forces which reduce distortion of the crankshaft (40) in the direction of the centrifugal force of the movable scroll (31). This state is the same as the state in which the crankshaft (40) is rotated with the three fluid-induced distortion reducing weights (81, 82, 83), the two balancing weights (91, 92), and the three centrifugal distortion reducing weights (101, 102, 103) provided at the main shaft (41). Thus, in the seventh aspect of the present disclosure, as well, abrasion of the bearings can be reduced and a reduction in bearing strength can be reduced when the fluid pressure is high. Further, a total weight and a total volume of the weights can be smaller compared to the case in which the three fluid-induced distortion reducing weights (81, 82, 83), the two balancing weights (91, 92), and the three centrifugal distortion reducing weights (101, 102, 103) are provided, and therefore, it is possible to reduce the weight of the scroll compressor (1) and reduce space for locating the weights, thereby reducing the size of the scroll compressor (1).

BRIEF DESCRIPTION OF THE DRAWINGS

FIG. 5 is a table showing centrifugal force during rotation of a weight of the third embodiment.

FIG. 7 is a table showing the centrifugal force and a direction of the gravity center (an angle in a rotational direction of the crankshaft, relative to an eccentric direction of the eccentric portion) during rotation of the weight of the fourth embodiment.

DESCRIPTION OF EMBODIMENTS

Embodiments of the present invention will be described in detail below, based on the drawings. The following embodiments are merely preferred examples in nature, and are not intended to limit the scope, applications, and use of the invention.

First Embodiment of Invention

Figure 1:
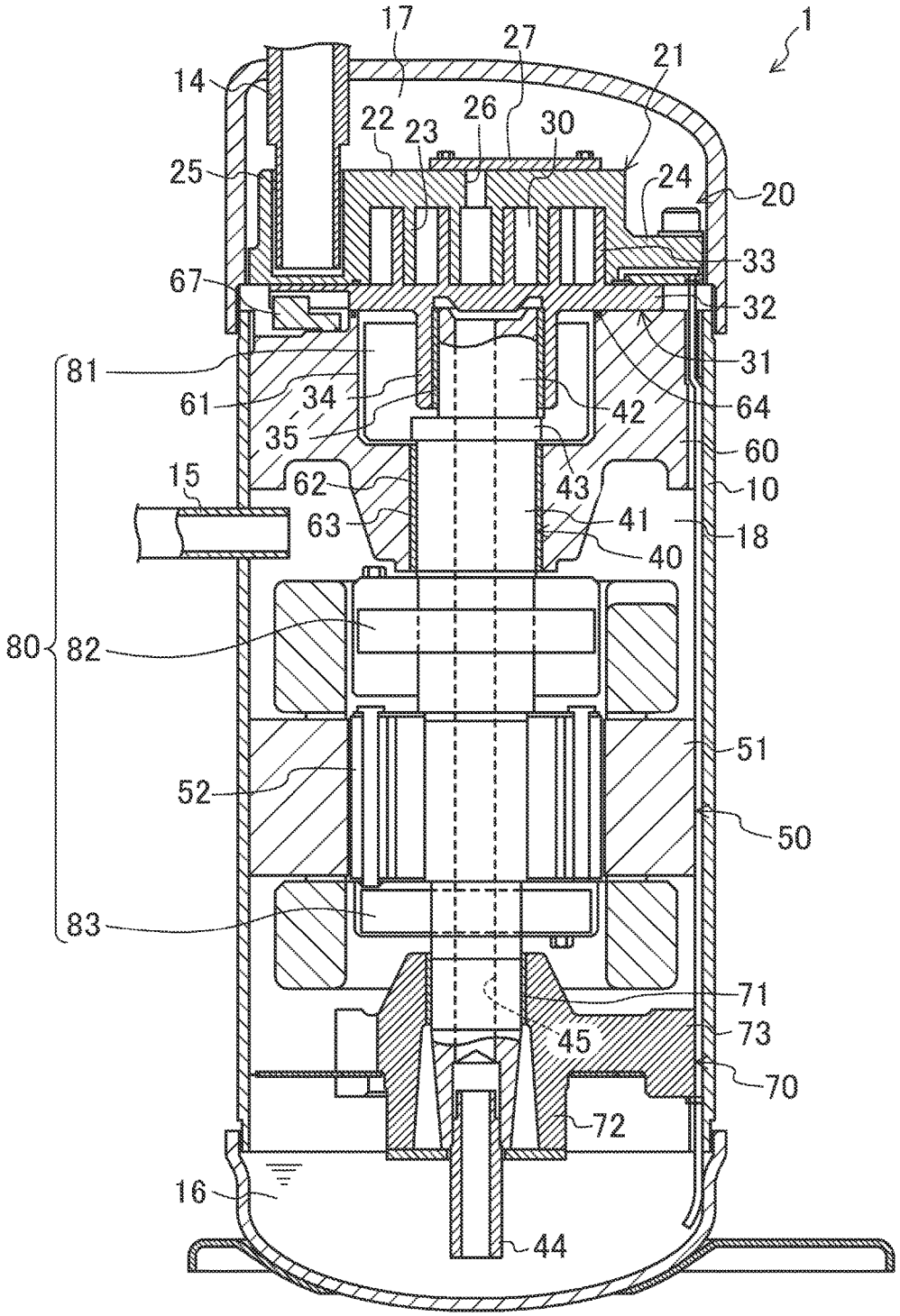
FIG. 1 is a vertical cross-section of a scroll compressor of the first embodiment.

A scroll compressor (1) of the present embodiment is connected, for example, to a refrigerant circuit (not shown) which performs a refrigeration cycle, and compresses a refrigerant. As shown in FIG. 1, the scroll compressor (1) includes a casing (10), a compression mechanism (20), a housing (60), a drive motor (50), a lower bearing portion (70), and a crankshaft (40).

The casing (10) is a cylindrically-shaped closed container with a vertically-extending axis. The compression mechanism (20), the housing (60), the drive motor (50), and the lower bearing portion (70) are arranged in the casing (10) sequentially from top to bottom. The crankshaft (40) is arranged in the casing (10) so as to be along the axis of the casing (10).

A suction pipe (14) penetrates and is fixed to an upper portion of the casing (10), for guiding the refrigerant of the refrigerant circuit to the compression mechanism (20). A discharge pipe (15) penetrates and is fixed to a middle portion of the casing (10), for discharging the refrigerant in the casing (10) to the refrigerant circuit. An oil reservoir (16) in which lubricating oil is stored is provided at a lower portion of the casing (10).

The crankshaft (40) includes a main shaft (41), an eccentric portion (42), and an oil suction portion (44). The main shaft (41) is arranged to extend vertically, and the top end of the main shaft (41) is provided with a protrusion (43) of which the entire side surface protrudes from the main shaft (41) in a radial direction. The eccentric portion (42) is eccentrically provided on a top surface of the protrusion (43), that is, on the top end of the main shaft (41). The eccentric portion (42) is in a columnar shape and protrudes upward from the top surface of the protrusion (43), and the axial center thereof is eccentric with the axial center of the main shaft (41). The oil suction portion (44) is in a cylindrical shape, with its one end fixed to a lower portion of the main shaft (41), and the other end immersed in the oil reservoir (16). An oil supply path (45) is formed in the crankshaft (40). The oil supply path (45) penetrates from the oil suction portion (44) at the bottom to the eccentric portion (42) at the top end.

The compression mechanism (20) includes a fixed scroll (21) which is fixed to a top surface of the housing (60), and a movable scroll (31) which engages with the fixed scroll (21).

The fixed scroll (21) includes an end plate (22), a spiral (involute) lap (23) formed on the front surface (the bottom surface in FIG. 1) of the end plate (22), and an outer peripheral wall (24) which is located on the outer side of the lap (23) and which is continuous with the lap (23). The end surface of the outer peripheral wall (24) and the end surface of the lap (23) are approximately flush with each other. The fixed scroll (21) is brought into contact with the top surface of the housing (60) and is fixed. A suction port (25) is formed in the outer peripheral wall (24), and the suction pipe (14) is airtightly connected to the suction port (25). A discharge port (26) which penetrates the end plate (22) of the fixed scroll (21) in the thickness direction is formed in a central portion of the end plate (22). The opening of the discharge port (26) on the back side (the top surface in FIG. 1) of the end plate (22) is closed by a lid member (27). The discharge port (26) communicates with a lower space (18) under the housing (60) through a path (not shown) formed in the end plate (22) of the fixed scroll (21) and the housing (60).

The movable scroll (31) includes an end plate (32) and a spiral (involute) lap (33) formed on the front surface (the top surface in FIG. 1) of the end plate (32). The lap (33) of the movable scroll (31) engages with the lap (23) of the fixed scroll (21). A compression chamber (30) that is a space defined by the two laps (23, 33) is formed between the end plate (22) of the fixed scroll (21) and the end plate (32) of the movable scroll (31). Further, a cylindrical boss (34) is integrally formed in a central portion of the back side of the end plate (32) of the movable scroll (31). A bearing (35) is press fitted in the boss (34). The eccentric portion (42) of the crankshaft (40) is rotatably supported by the bearing (35).

Figure 2:
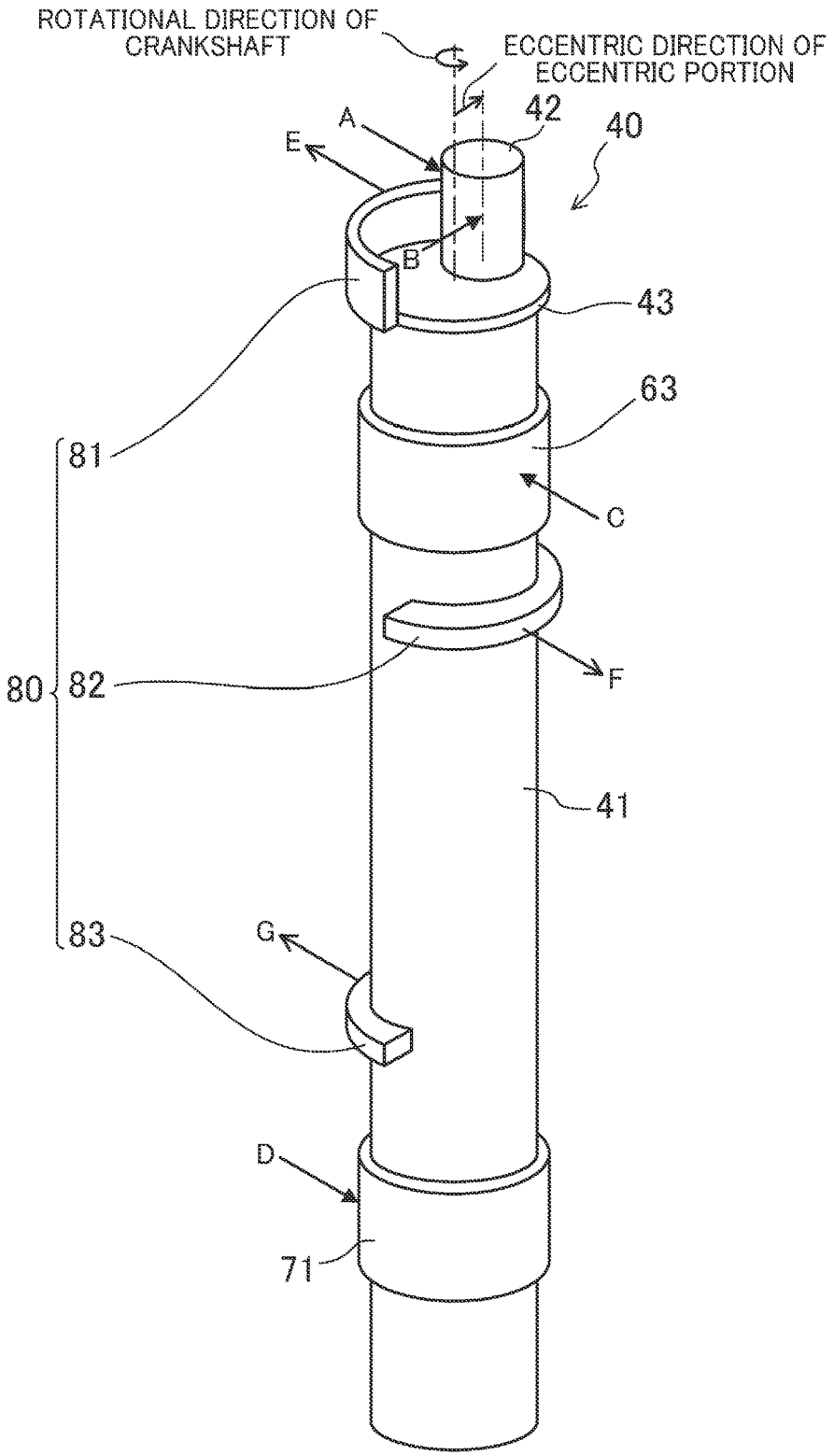
FIG. 2 is a diagram showing loads applied to a crankshaft of the first embodiment.

As described above, the eccentric portion (42) is coupled to the back side of the movable scroll (31). Thus, when the crankshaft (40) is rotated, a fluid load A generated in the compression chamber (30) is applied to the eccentric portion (42) as shown in FIG. 2. The fluid load A is applied in a direction approximately opposite to a direction of movement of the eccentrically rotating movable scroll (31). Specifically, the fluid load A is applied in a direction inclined at 55 degrees to 145 degrees relative to the eccentric direction of the eccentric portion (42), and opposite to a rotational direction of the crankshaft (40). Further, centrifugal force B of the movable scroll (31) is applied to the eccentric portion (42) by the rotation of the crankshaft (40). The centrifugal force B of the movable scroll (31) is applied in the eccentric direction of the eccentric portion (42).

The housing (60) is in a bowl shape with an annular outer periphery and a recess (61) at a central portion of a top surface as shown in FIG. 1. The outer periphery of the housing (60) is press fitted to the casing (10) to provide airtight seal. Thus, the housing (60) partitions the interior of the casing (10) into an upper space (17) accommodating the compression mechanism (20), and the lower space (18) accommodating the drive motor (50).

The housing (60) has a through hole (62) which passes through the housing (60) from the bottom of the recess (61) to the lower end of the housing (60). An upper bearing (63) is press fitted in the through hole (62). An upper portion of the main shaft (41) is rotatably supported by the upper bearing (63). Thus, as shown in FIG. 2, when the fluid load A is applied to the eccentric portion (42), counterforce C in a direction opposite to the fluid load A is applied to the portion of the main shaft (41) supported by the upper bearing (63).

Further, as shown in FIG. 1, an annular sealing member (64) is provided in the top surface of the housing (60) at the outer peripheral edge of the recess (61). The sealing member (64) is held in contact with the back side of the end plate (32) of the movable scroll (31), and partitions the space on the back side of the movable scroll (31) into a space on the inner side of the sealing member (64) and a space on the outer side of the sealing member (64). The space on the inner side of the sealing member (64) is formed of the recess (61) and the oil supply path (45) which communicates with the recess (61). On the other hand, the space on the outer side of the sealing member (64) is formed of a gap between the outer periphery of the housing (60) and the movable scroll (31). An Oldham coupling (67) for preventing rotation of the movable scroll (31) on its axis is provided in the space on the outer side of the sealing member (64). The Oldham coupling (67) is engaged with a key groove (not shown) formed in the back side of the end plate (32) of the movable scroll (31), and a key groove (not shown) formed in the top surface of the outer periphery of the housing (60).

The drive motor (50) includes a stator (51) and a rotor (52). The stator (51) is fixed to the casing (10) by shrinkage fit by heating, etc. The rotor (52) is positioned inside the stator (51) to be coaxial with the stator (51), and is fixed to the main shaft (41) of the crankshaft (40) by shrinkage fit by heating, etc.

The lower bearing portion (70) includes a tubular bearing holder (72) and a fixed portion (73) which protrudes outward from an outer circumferential surface of the bearing holder (72) and is fixed to the casing (10). A lower bearing (71) is press fitted in the bearing holder (72), and a lower portion of the main shaft (41) is rotatably supported by the lower bearing (71). Thus, as shown in FIG. 2, counterforce D opposite to the counterforce C is applied to the portion of the main shaft (41) supported by the lower bearing (71), when the fluid load A is applied to the eccentric portion (42) and the counterforce C is applied to the portion of the main shaft (41) supported by the upper bearing (63).

The main shaft (41) of the crankshaft (40) is provided with an upper fluid-induced distortion reducing weight (81), a middle fluid-induced distortion reducing weight (82), and a lower fluid-induced distortion reducing weight (83) as shown in FIG. 1. These three fluid-induced distortion reducing weights (81, 82, 83) reduce distortion of the crankshaft (40) in the direction of the fluid load A during rotation, and comprise part of a weight (80) of the present invention.

Each of the three fluid-induced distortion reducing weights (81, 82, 83) is C-shaped in plan view, as shown in FIG. 2. The upper fluid-induced distortion reducing weight (81) is attached to a side surface of the protrusion (43) (hereinafter referred to as the upper portion of the main shaft (41)) which is away from the axial center of the main shaft (41) in a direction opposite to the direction of the fluid load A. The middle fluid-induced distortion reducing weight (82) is attached to a side surface of a portion between the housing (60) and the rotor (52) (hereinafter referred to as the middle portion of the main shaft (41)) which is opposite to the side where the upper fluid-induced distortion reducing weight (81) is provided, relative to the axial center of the main shaft (41). The lower fluid-induced distortion reducing weight (83) is attached to a side surface of a portion between the rotor (52) and the lower bearing portion (70) (hereinafter referred to as the lower portion of the main shaft (41)) which is on the same side where the upper fluid-induced distortion reducing weight (81) is positioned, relative to the axial center of the main shaft (41). The center of gravity of each of the upper fluid-induced distortion reducing weight (81) and the lower fluid-induced distortion reducing weight (83) is located away from the axial center of the main shaft (41) in the direction opposite to the direction of the fluid load A. The center of gravity of the middle fluid-induced distortion reducing weight (82) is located away from the axial center of the main shaft (41) in the direction of the fluid load A.

—Operation—

In the scroll compressor (1), the crankshaft (40) rotates and the movable scroll (31) eccentrically rotates when the drive motor (50) is driven. The movable scroll (31) does not rotate on its axis, but only makes an orbital motion, because its rotation is restricted by the Oldham coupling (67).

When the movable scroll (31) makes an orbital motion, a low-pressure fluid (gas refrigerant) of the refrigerant circuit is sucked in the compression chamber (30) from the suction pipe (14) through the suction port (25). When the movable scroll (31) makes a further orbital motion, the compression chamber (30) is blocked from the suction port (25) and is closed, and moves toward a central portion along the lap (23) of the fixed scroll (21) and the lap (33) of the movable scroll (31). In the course of this movement, the capacity of the compression chamber (30) is gradually reduced, and the fluid in the compression chamber (30) is compressed.

After the capacity of the compression chamber (30) is reduced, the compression chamber (30) gradually communicates with the discharge port (26). The fluid compressed in the compression chamber (30) flows out from the discharge port (26) into the lower space (18) through a path (not shown) formed in the end plate (22) of the fixed scroll (21) and the housing (60), and is discharged to the refrigerant circuit through the discharge pipe (15).

In the scroll compressor (1), the fluid pressure of the fluid compressed in the compression chamber (30) serves as a load during rotation, and the fluid load A is applied to the eccentric portion (42). When the fluid load A is applied to the eccentric portion (42), the counterforce C is applied to the upper portion of the main shaft (41) supported by the upper bearing (63), and the counterforce D is applied to the lower portion of the main shaft (41) supported by the lower bearing (71). The fluid load A, the counterforce C and the counterforce D increase as the fluid pressure increases. Thus, the crankshaft (40) is forced to be significantly distorted in the direction of the fluid load A when the fluid pressure is high.

However, in the present embodiment, distortion of the crankshaft (40) in the direction of the fluid load A is reduced by the centrifugal forces of the three fluid-induced distortion reducing weights (81, 82, 83) provided on the main shaft (41).

Specifically, when the crankshaft (40) is rotated, centrifugal force E of the upper fluid-induced distortion reducing weight (81) is applied in a direction opposite to the direction of the fluid load A; centrifugal force F of the middle fluid-induced distortion reducing weight (82) is applied in the same direction as the direction of the fluid load A; and centrifugal force G of the lower fluid-induced distortion reducing weight (83) is applied in a direction opposite to the direction of the fluid load A, as shown in FIG. 2. The centrifugal forces E, F and G of the three fluid-induced distortion reducing weights (81, 82, 83) are balanced with one another. Further, the applying directions are opposite between the centrifugal force E and the fluid load A, between the centrifugal force F and the counterforce C, and between the centrifugal force G and the counterforce D. This means that the centrifugal forces E, F and G of the three fluid-induced distortion reducing weights (81, 82, 83) are applied such that the distortion of the crankshaft (40) in the direction of the fluid load A due to the fluid load A, the counterforce C, and the counterforce D is reduced. As a result, excessively high contact pressure is prevented from being locally generated due to uneven contact of the crankshaft (40) with the bearings (63, 71), thereby reducing abrasion of the bearings (63, 71).

Advantages of Embodiments

In the present embodiment, the main shaft (41) of the crankshaft (40) is provided with a weight (80) configured to reduce distortion of the crankshaft (40) caused by the fluid load A applied to the eccentric portion (42) during rotation. It is therefore possible to reduce distortion of the crankshaft (40) in the direction of the fluid load A when the fluid pressure is high. As a result, abrasion of the bearing and a reduction in bearing strength due to the abrasion can be reduced, compared to the conventional cases.

In the present embodiment, the three fluid-induced distortion reducing weights (81, 82, 83) are provided as the weight (80). Thus, it is possible to reliably create a state in which distortion of the crankshaft (40) in the direction of the fluid load A is reduced.

Variation of First Embodiment

The first embodiment may have the following configurations.

In the first embodiment, the middle fluid-induced distortion reducing weight (82) is attached to the middle portion of the main shaft (41) (a portion between the housing (60) and the rotor (52)). However, the middle fluid-induced distortion reducing weight (82) may be attached to the top surface of the rotor (52). Further, the lower fluid-induced distortion reducing weight (83) is attached to the lower portion of the main shaft (41) (a portion between the rotor (52) and the lower bearing portion (70)). However, the lower fluid-induced distortion reducing weight (83) may be attached to the bottom surface of the rotor (52).

In the first embodiment, each of the three fluid-induced distortion reducing weights (81, 82, 83) is C-shaped in plan view, and is attached to a side surface of the main shaft (41). However, the shape and the location are not limited to such a shape and a location as long as the center of gravity of each of the upper fluid-induced distortion reducing weight (81) and the lower fluid-induced distortion reducing weight (83) may be located away from the axial center of the main shaft (41) in the direction opposite to the direction of the fluid load A, and the center of gravity of the middle fluid-induced distortion reducing weight (82) may be located away from the axial center of the main shaft (41) in the same direction as the direction of the fluid load A.

Second Embodiment

Figure 3:
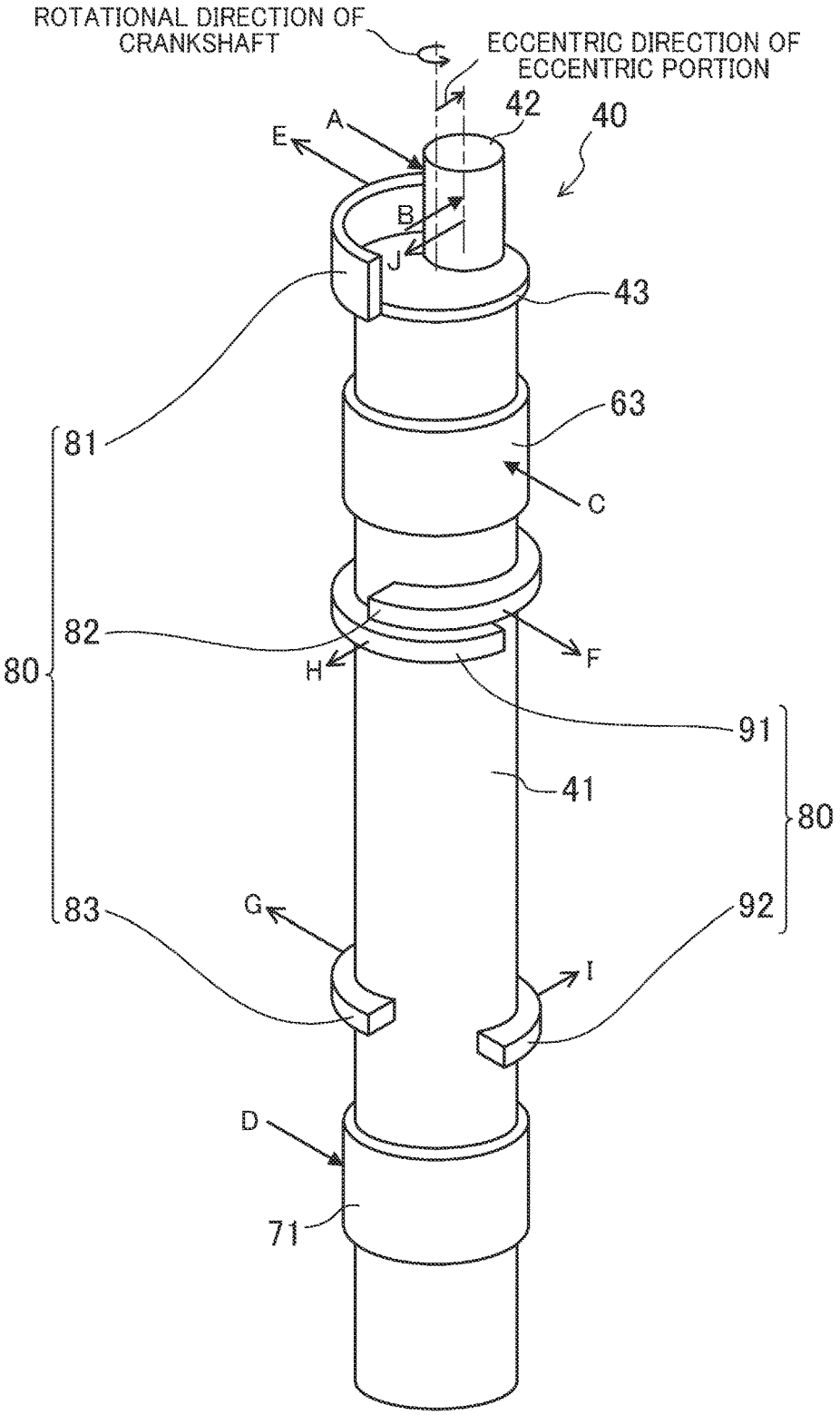
FIG. 3 is a diagram showing loads applied to a crankshaft of the second embodiment.

Now, the second embodiment of the present invention will be described in detail based on the drawings. In the second embodiment, the number of weights in the first embodiment has been changed. That is, there are three fluid-induced distortion reducing weights (81, 82, 83) provided on the main shaft (41) in the first embodiment, whereas in the second embodiment, two balancing weights (91, 92) are provided in addition to the three fluid-induced distortion reducing weights (81, 82, 83) as shown in FIG. 3.

A first balancing weight (91) and a second balancing weight (92) are provided on the main shaft (41) of the crankshaft (40). The two balancing weights (91, 92) are balanced with the centrifugal force B of the movable scroll (31) during rotation, and comprise part of the weight (80) of the present invention. Each of the two balancing weights (91, 92) is C-shaped in plan view. The first balancing weight (91) is attached to a side surface of the middle portion of the main shaft (41) which is opposite to the side where the eccentric portion (42) is positioned, relative to the axial center of the main shaft (41). The second balancing weight (92) is attached to a side surface of the lower portion of the main shaft (41) which is opposite to the side where the first balancing weight (91) is provided, relative to the axial center of the main shaft (41). The center of gravity of the first balancing weight (91) is located opposite to the eccentric portion (42) relative to the axial center of the main shaft (41). The center of gravity of the second balancing weight (92) is located on the same side where the eccentric portion (42) is positioned, relative to the axial center of the main shaft (41).

When the crankshaft (40) with the first balancing weight (91) and the second balancing weight (92) attached thereto is rotated, centrifugal force H of the first balancing weight (91) is applied to the middle portion of the main shaft (41) in the direction opposite to the eccentric direction of the eccentric portion (42), and centrifugal force I of the second balancing weight (92) is applied to the lower portion of the main shaft (41) in the same direction as the eccentric direction of the eccentric portion (42). When the two centrifugal forces H and I are applied to the main shaft (41), a force J in a direction opposite to the eccentric direction of the eccentric portion (42), that is, opposite to the centrifugal force B of the movable scroll (31) is applied to the eccentric portion (42) to balance the centrifugal force B of the movable scroll (31), thereby maintaining the posture of the crankshaft (40). As a result, the uneven contact of the crankshaft (40) with the bearings (63, 71) is further prevented, thereby reducing abrasion of the bearings (63, 71) with more reliability. The other configurations, effects and advantages are the same as those in the first embodiment.

Variation of Second Embodiment

The second embodiment may have the following configurations.

In the second embodiment, the middle fluid-induced distortion reducing weight (82) and the first balancing weight (91) are attached to the middle portion of the main shaft (41) (a portion between the housing (60) and the rotor (52)). However, the location where the weights are attached is not limited to this portion, and at least one of the two weights (82, 91) may be attached to the top surface of the rotor (52).

In the second embodiment, the lower fluid-induced distortion reducing weight (83) and the second balancing weight (92) are attached to the lower portion of the main shaft (41) (a portion between the rotor (52) and the lower bearing portion (70)). However, the location where the weights are attached is not limited to this portion, and at least one of the two weights (83, 92) may be attached to the bottom surface of the rotor (52).

In the second embodiment, each of the two balancing weights (91, 92) is C-shaped in plan view, and is attached to a side surface of the main shaft (41). However, the shape and the location are not limited to such a shape and a location as long as the center of gravity of the first balancing weight (91) is located on a side opposite to the side where the eccentric portion (42) is positioned relative to the axial center of the main shaft (41), and the center of gravity of the second balancing weight (92) is located on the same side where the eccentric portion (42) is positioned relative to the axial center of the main shaft (41).

Further, in the second embodiment, the first balancing weight (91) is provided at the middle portion of the main shaft (41). However, the location is not limited to this portion, and the first balancing weight (91) may be provided, for example, at the upper portion of the main shaft (41) to apply the centrifugal force H.

In the second embodiment, the fluid-induced distortion reducing weights (81, 82, 83) and the balancing weights (91, 92) are independently provided, but are not limited to this configuration. For example, the middle fluid-induced distortion reducing weight (82) and the first balancing weight (91) may be integrally formed. Even if any one of the fluid-induced distortion reducing weights (81, 82, 83) and any one of the balancing weights (91, 92) are integrally formed, the advantages are the same.

Third Embodiment

Figure 4:
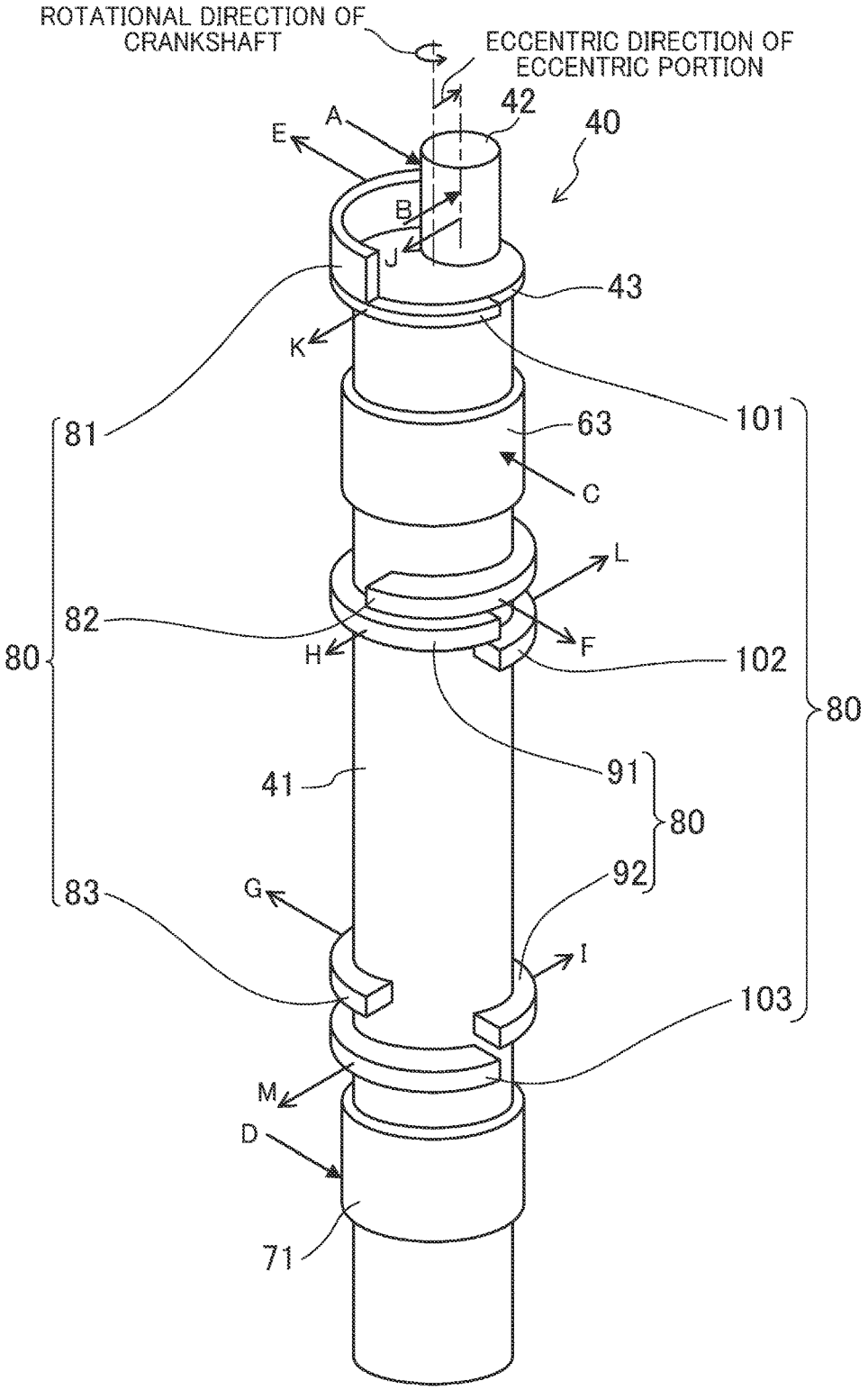
FIG. 4 is a diagram showing loads applied to a crankshaft of the third embodiment.

Now, the third embodiment of the present invention will be described in detail based on the drawings. In the third embodiment, the number of weights in the second embodiment has been changed. That is, there are three fluid-induced distortion reducing weights (81, 82, 83) and two balancing weights (91, 92) provided on the main shaft (41) in the second embodiment, whereas in the third embodiment, three centrifugal distortion reducing weights (101, 102, 103) are provided in addition to the three fluid-induced distortion reducing weights (81, 82, 83) and the two balancing weights (91, 92) as shown in FIG. 4 and FIG. 5.

An upper centrifugal distortion reducing weight (101), a middle centrifugal distortion reducing weight (102), and a lower centrifugal distortion reducing weight (103) are attached to the main shaft (41) of the crankshaft (40). The three centrifugal distortion reducing weights (101, 102, 103) are configured to reduce distortion of the crankshaft (40) caused by balancing the centrifugal force B of the movable scroll (31) with the centrifugal forces H and I of the two balancing weights (91, 92), and comprise part of the weight (80) of the present invention. Each of the three centrifugal distortion reducing weights (101, 102, 103) is C-shaped in plan view. The upper centrifugal distortion reducing weight (101) is attached to a side surface of an upper portion of the main shaft (41) which is opposite to the side where the eccentric portion (42) is positioned, relative to the axial center of the main shaft (41). The middle centrifugal distortion reducing weight (102) is attached to a side surface of a middle portion of the main shaft (41) which is opposite to the side where the upper centrifugal distortion reducing weight (101) is located, relative to the axial center of the main shaft (41). The lower centrifugal distortion reducing weight (103) is attached to a side surface of a lower portion of the main shaft (41) which is on the same side where the upper centrifugal distortion reducing weight (101) is located, relative to the axial center of the main shaft (41). The center of gravity of the upper centrifugal distortion reducing weight (101) and the center of gravity of the lower centrifugal distortion reducing weight (103) are located opposite to the eccentric portion (42) relative to the axial center of the main shaft (41). The center of gravity of the middle centrifugal distortion reducing weight (102) is located on the side where the eccentric portion (42) is positioned, relative to the axial center of the main shaft (41).

When the crankshaft (40) with the three centrifugal distortion reducing weights (101, 102, 103) attached thereto is rotated, a centrifugal force K of the upper centrifugal distortion reducing weight (101) is applied to an upper portion of the main shaft (41) in the direction opposite to the eccentric direction of the eccentric portion (42). Further, a centrifugal force L of the middle centrifugal distortion reducing weight (102) is applied to a middle portion of the main shaft (41) in the same direction as the eccentric direction of the eccentric portion (42). A centrifugal force M of the lower centrifugal distortion reducing weight (103) is applied to a lower portion of the main shaft (41) in the direction opposite to the eccentric direction of the eccentric portion (42). The centrifugal forces K, L and M of the three centrifugal distortion reducing weights (101, 102, 103) are balanced with each other. Further, the applying directions are opposite between the centrifugal force K and the centrifugal force B of the movable scroll (31), between the centrifugal force L and the centrifugal force H of the first balancing weight (91), and between the centrifugal force M and centrifugal force I of the second balancing weight (92). This means that the centrifugal forces K, L and M of the three centrifugal distortion reducing weights (101, 102, 103) are applied in a direction which reduces the distortion of the crankshaft (40) caused by the centrifugal forces B, H and I of the movable scroll (31) and the two balancing weights (91, 92). Thus, even when the number of revolutions of the crankshaft (40) is high, and the centrifugal forces B, H and I of the movable scroll (31) and the two balancing weights (91, 92) are large, the distortion of the crankshaft (40) can be reduced by the centrifugal forces K, L and M of the centrifugal distortion reducing weights (101, 102, 103). As a result, uneven contact of the crankshaft (40) with the bearings (63, 71) can be further reduced, thereby making it possible to reduce abrasion of the bearings (63, 71) with more reliability. The other configurations, effects and advantages are the same as those in the second embodiment.

Variation of Third Embodiment

The third embodiment may have the following configurations.

In the third embodiment, the middle fluid-induced distortion reducing weight (82), the first balancing weight (91), and the middle centrifugal distortion reducing weight (102) are attached to the middle portion of the main shaft (41)(a portion between the housing (60) and the rotor (52)). However, the location where the weights are attached is not limited to this portion, and at least one of the three weights (82, 91, 102) may be attached to the top surface of the rotor (52).

In the third embodiment, the lower fluid-induced distortion reducing weight (83), the second balancing weight (92), and the lower centrifugal distortion reducing weight (103) are attached to the lower portion of the main shaft (41) (a portion between the rotor (52) and the lower bearing portion (70)). However, the location where the weights are attached is not limited to this portion, and at least one of the three weights (83, 92, 103) may be attached to the bottom surface of the rotor (52).

In the third embodiment, each of the centrifugal distortion reducing weights (101, 102, 103) is C-shaped in plan view, and is attached to a side surface of the main shaft (41). However, the shape and the location are not limited to such a shape and a location as long as the center of gravity of each of the upper centrifugal distortion reducing weight (101) and the lower centrifugal distortion reducing weight (103) is located on a side opposite to the side where the eccentric portion (42) is positioned relative to the axial center of the main shaft (41), and the center of gravity of the middle centrifugal distortion reducing weight (102) is located on the same side where the eccentric portion (42) is positioned relative to the axial center of the main shaft (41).

Further, in the third embodiment, the first balancing weight (91) is provided at the middle portion of the main shaft (41). However, the location is not limited to this portion, and the first balancing weight (91) may be provided, for example, at the upper portion of the main shaft (41) to apply the centrifugal force H.

In the third embodiment, the fluid-induced distortion reducing weights (81, 82, 83), the balancing weights (91, 92) and the centrifugal distortion reducing weights (101, 102, 103) are independently provided, but are not limited to this configuration. Even if any one of the fluid-induced distortion reducing weights (81, 82, 83) and any one of the balancing weights (91, 92) and the centrifugal distortion reducing weights (101, 102, 103) may be integrally formed, the advantages are the same.

Fourth Embodiment

Figure 6:
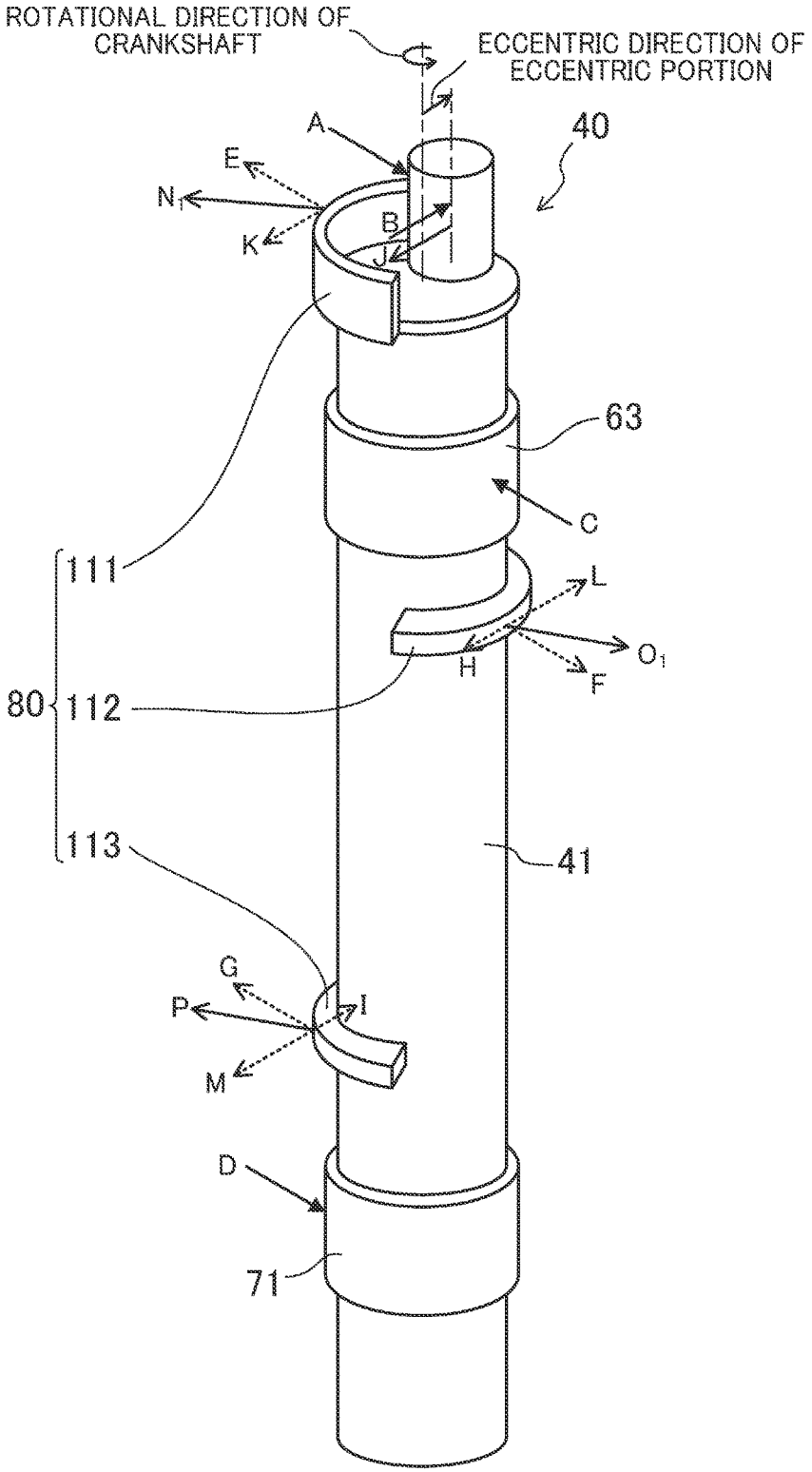
FIG. 6 is a diagram showing loads applied to a crankshaft of the fourth embodiment.

Now, the fourth embodiment of the present invention will be described in detail based on the drawings. In the fourth embodiment, the number of weights (80) in the third embodiment has been changed. That is, in the third embodiment, the main shaft (41) is provided with eight weights (81, 82, 91-93 and 101-103) in total, whereas in the fourth embodiment, three weights (111, 112, 113) are provided as shown in FIG. 6 and FIG. 7.

The main shaft (41) of the crankshaft (40) is provided with an upper weight (111), a middle weight (112), and a lower weight (113). The upper weight (111), the middle weight (112), and the lower weight (113) reduce distortion of the crankshaft (40) in the direction of the fluid load A, balance the centrifugal force B of the movable scroll (31), and further reduce distortion of the crankshaft (40) caused by balancing the centrifugal force B of the movable scroll (31). The upper weight (111), the middle weight (112) and the lower weight (113) are attached to an upper portion, a middle portion, and a lower portion of the main shaft (41). The upper weight (111) is configured to generate a centrifugal force N1 which has the same magnitude as a total force of the centrifugal force E of the upper fluid-induced distortion reducing weight (81) and the centrifugal force K of the upper centrifugal distortion reducing weight (101) during rotation. The middle weight (112) is configured to generate a centrifugal force O1 which has the same magnitude as a total force of the centrifugal force F of the middle fluid-induced distortion reducing weight (82), the centrifugal force H of the first balancing weight (91), and the centrifugal force L of the middle centrifugal distortion reducing weight (102). The lower weight (113) is configured to generate a centrifugal force P which has the same magnitude as a total force of the centrifugal force G of the lower fluid-induced distortion reducing weight (83), the centrifugal force I of the second balancing weight (92), and the centrifugal force M of the lower centrifugal distortion reducing weight (103) during rotation. The centrifugal force E, the centrifugal force F, the centrifugal force G, the centrifugal force H, the centrifugal force I, the centrifugal force K, the centrifugal force L, and the centrifugal force M comprise the first force, the second force, the third force, the fourth force, the fifth force, the sixth force, the seventh force, and the eighth force of the present invention, respectively.

In the fourth embodiment, a state similar to the state of the third embodiment is created. Specifically, a state is created in which three centrifugal forces E, F and G which reduce distortion of the crankshaft (40) in the direction of the fluid load A are generated; two centrifugal forces H and I which balance the centrifugal force B of the movable scroll (31) are generated; and three centrifugal forces K, L and M are generated which reduce distortion of the crankshaft (40) caused by balancing the centrifugal force B of the movable scroll (31) with the two centrifugal forces H and I. Thus, similar to the third embodiment, abrasion of the bearing can be reduced, and a reduction in bearing strength can therefore be reduced when the fluid pressure is high, in the fourth embodiment, as well. Further, a total weight and a total volume of the weights can be smaller than those in the third embodiment, and therefore, it is possible to reduce the weight of the scroll compressor (1) and reduce space for locating the weights, thereby reducing the size of the scroll compressor (1). The other configurations, effects and advantages are the same as those in third embodiment.

Variation of Fourth Embodiment

The fourth embodiment may have the following configurations.

In the fourth embodiment, the middle weight (112) is attached to the middle portion of the main shaft (41) (a portion between the housing (60) and the rotor (52)), but the middle weight (112) may be attached to the top surface of the rotor (52). Further, the lower weight (113) is attached to the lower portion of the main shaft (41) (a portion between the rotor (52) and the lower bearing portion (70)), but the lower weight (113) may be attached to the bottom surface of the rotor (52).

In the fourth embodiment, each of the upper weight (111), the middle weight (112) and the lower weight (113) is C-shaped in plan view, and is attached to a side surface of the main shaft (41). However, the shape and the location are not limited to such a shape and a location.

Figure 8:
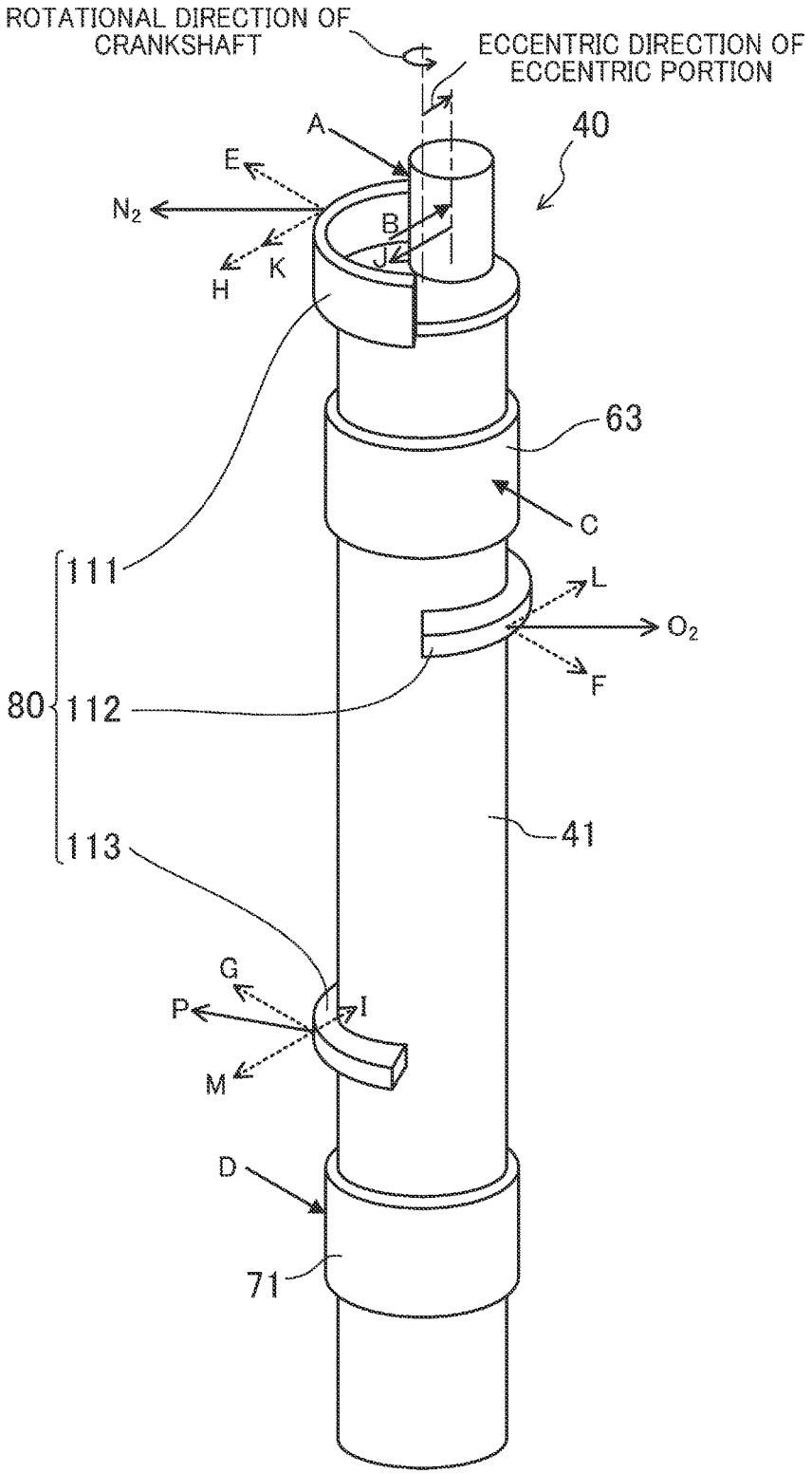
FIG. 8 is a diagram showing loads applied to a crankshaft of a variation of the fourth embodiment.

In the fourth embodiment, the upper weight (111) which generates the total force N1 of the centrifugal force E and the centrifugal force K during rotation, and the middle weight (112) which generates the total force O1 of the centrifugal force F, the centrifugal force H, and the centrifugal force L during rotation, are provided. However, the configurations of the upper weight (111) and the middle weight (112) are not limited to the above configurations, and may be such that the upper weight (111) generates a total force N2 of the centrifugal force E, the centrifugal force H, and the centrifugal force K during rotation, and that the middle weight (112) generates a total force O2 of the centrifugal force F and the centrifugal force L during rotation, as shown in FIG. 8.

INDUSTRIAL APPLICABILITY

As described above, the present invention is useful as a scroll compressor which is connected to a refrigerant circuit performing a refrigeration cycle, and compresses a refrigerant.

What is claimed is:

1. A scroll compressor, comprising:

a compression mechanism including a fixed scroll and a movable scroll engaged with each other to form a compression chamber configured to compress a fluid;

a crankshaft having a main shaft and an eccentric portion eccentrically disposed at one end of the main shaft and coupled to a back side of the movable scroll;

an upper bearing supporting an upper portion of the main shaft of the crankshaft;

a lower bearing supporting a lower portion of the main shaft of the crankshaft; and a drive motor having a stator and a rotor coupled to the main shaft of the crankshaft to rotate the movable scroll, the scroll compressor having a weight array including a fluid-induced distortion reducing weight arranged to reduce distortion of the crankshaft in a direction of a fluid load that is generated in the compression chamber and applied to the eccentric portion during rotation, the weight array being provided to at least one of the main shaft of the crankshaft and the rotor, the fluid-induced distortion reducing weight including an upper fluid-induced distortion reducing weight disposed at an upper portion of the main shaft and having a center of gravity spaced from an axial center of the main shaft in a direction opposite to the direction of the fluid load, a middle fluid-induced distortion reducing weight disposed at a middle portion of the main shaft and having a center of gravity spaced from the axial center of the main shaft in a same direction as the direction of the fluid load, and a lower fluid-induced distortion reducing weight disposed at a lower portion of the main shaft and having a center of gravity spaced from the axial center of the main shaft in the direction opposite to the direction of the fluid load, the upper fluid-induced distortion reducing weight, the middle fluid-induced distortion reducing weight, and the lower fluid-induced distortion reducing weight being separate weight elements, and being arranged and configured such that a first centrifugal force of the upper fluid-induced distortion reducing weight, a second centrifugal force of the middle fluid-induced distortion reducing weight, and a third centrifugal force of the lower fluid-induced distortion reducing weight contribute a zero net centrifugal force when the crankshaft is rotated.

2. The scroll compressor of claim 1, wherein the weight array includes a balancing weight arranged to balance a centrifugal force of the movable scroll during rotation, the balancing weight including a first balancing weight having a center of gravity located opposite to the eccentric portion relative to the axial center of the main shaft, and a second balancing weight farther from the eccentric portion than the first balancing weight and having a center of gravity located on a same side as where the eccentric portion is positioned, relative to the axial center of the main shaft.

3. The scroll compressor of claim 2, wherein the weight array includes a centrifugal distortion reducing weight arranged to reduce distortion of the crankshaft caused by balancing the centrifugal force of the movable scroll with a centrifugal force of the balancing weight, the centrifugal distortion reducing weight including an upper centrifugal distortion reducing weight disposed at an upper portion of the main shaft and having a center of gravity located opposite to the eccentric portion relative to the axial center of the main shaft, a middle centrifugal distortion reducing weight disposed at a middle portion of the main shaft and having a center of gravity located on the same side as where the eccentric portion is positioned, relative to the axial center of the main shaft, and a lower centrifugal distortion reducing weight disposed at a lower portion of the main shaft and having a center of gravity located opposite to the eccentric portion relative to the axial center of the main shaft, and the upper centrifugal distortion reducing weight, the middle centrifugal distortion reducing weight, and the lower centrifugal distortion reducing weight being arranged and configured such that a fourth centrifugal force of the upper centrifugal distortion reducing weight, a fifth centrifugal force of the middle centrifugal distortion reducing weight, and a sixth centrifugal force of the lower centrifugal distortion reducing weight contribute a zero net centrifugal force when the crankshaft is rotated.

4. The scroll compressor of claim 3, wherein each of the upper fluid-induced distortion reducing weight, the middle fluid-induced distortion reducing weight, the lower fluid-induced distortion reducing weight, the first balancing weight, the second balancing weight, the upper centrifugal distortion reducing weight, the middle centrifugal distortion reducing weight, and the lower centrifugal distortion reducing weight is provided as a separate weight element.

5. The scroll compressor of claim 4, wherein the upper fluid-induced distortion reducing weight, the middle fluid-induced distortion reducing weight, the lower fluid-induced distortion reducing weight, the first balancing weight, the second balancing weight, the upper centrifugal distortion reducing weight, the middle centrifugal distortion reducing weight, and the lower centrifugal distortion reducing weight are spaced apart from one another along an axial direction of the crankshaft.

6. The scroll compressor of claim 2, wherein each of the upper fluid-induced distortion reducing weight, the middle fluid-induced distortion reducing weight, the lower fluid-induced distortion reducing weight, the first balancing weight, and the second balancing weight is provided as a separate weight element.

7. The scroll compressor of claim 6, wherein the upper fluid-induced distortion reducing weight, the middle fluid-induced distortion reducing weight, the lower fluid-induced distortion reducing weight, the first balancing weight, and the second balancing weight are spaced apart from one another along an axial direction of the crankshaft.

8. A scroll compressor, comprising:

a compression mechanism including a fixed scroll and a movable scroll engaged with each other to form a compression chamber configured to compress a fluid;

a crankshaft having a main shaft and an eccentric portion eccentrically disposed at one end of the main shaft and coupled to a back side of the movable scroll;

an upper bearing supporting an upper portion of the main shaft of the crankshaft;

a lower bearing supporting a lower portion of the main shaft of the crankshaft; and a drive motor having a stator and a rotor, the rotor being coupled to the main shaft of the crankshaft to rotate the movable scroll, the scroll compressor having a weight array including a fluid-induced distortion reducing weight, a balancing weight, and a centrifugal distortion reducing weight, the weight array being provided to at least one of the main shaft of the crankshaft and the rotor, the fluid-induced distortion reducing weight being arranged and configured to reduce distortion of the crankshaft in a direction of a fluid load generated in the compression chamber and applied to the eccentric portion during rotation, the fluid-induced distortion reducing weight including:

an upper fluid-induced distortion reducing weight disposed at an upper portion of the main shaft and having a center of gravity spaced from an axial center of the main shaft in a direction opposite to the direction of the fluid load, the upper fluid-induced distortion reducing weight being arranged to generate a first centrifugal force when the main shaft rotates, a middle fluid-induced distortion reducing weight disposed at a middle portion of the main shaft and having a center of gravity spaced from the axial center of the main shaft in a same direction as the direction of the fluid load, the middle fluid-induced distortion reducing weight being arranged to generate a second centrifugal force when the main shaft rotates, and a lower fluid-induced distortion reducing weight disposed at a lower portion of the main shaft and having a center of gravity spaced from the axial center of the main shaft in the direction opposite to the direction of the fluid load, the lower fluid-induced distortion reducing weight being arranged to generate a third centrifugal force when the main shaft rotates, the upper fluid-induced distortion reducing weight, the middle fluid-induced distortion reducing weight, and the lower fluid-induced distortion reducing weight being arranged and configured such that the first, second, and third centrifugal forces contribute a zero net centrifugal force during rotation, the balancing weight being arranged and configured to balance a centrifugal force of the movable scroll during rotation, the balancing weight including:

a first balancing weight having a center of gravity located opposite to the eccentric portion relative to the axial center of the main shaft, the first balancing weight being arranged to generate a fourth centrifugal force when the main shaft rotates, and a second balancing weight farther from the eccentric portion than the first balancing weight and having a center of gravity located on a same side as where the eccentric portion is positioned, relative to the axial center of the main shaft, the second balancing weight being arranged to generate a fifth centrifugal force when the main shaft rotates, the centrifugal distortion reducing weight being arranged to reduce distortion of the crankshaft caused by balancing the centrifugal force of the movable scroll with a centrifugal force of the balancing weight, the centrifugal distortion reducing weight including:

an upper centrifugal distortion reducing weight disposed at an upper portion of the main shaft and having a center of gravity located opposite to the eccentric portion relative to the axial center of the main shaft, the upper centrifugal distortion reducing weight being arranged to generate a sixth centrifugal force when the main shaft rotates, a middle centrifugal distortion reducing weight disposed at a middle portion of the main shaft and having a center of gravity located on the same side as where the eccentric portion is positioned, relative to the axial center of the main shaft, the middle centrifugal distortion reducing weight being arranged to generate a seventh centrifugal force when the main shaft rotates, and a lower centrifugal distortion reducing weight disposed at a lower portion of the main shaft and having a center of gravity located opposite to the eccentric portion relative to the axial center of the main shaft, the lower centrifugal distortion reducing weight being arranged to generate an eighth centrifugal force when the main shaft rotates, the upper centrifugal distortion reducing weight, the middle centrifugal distortion reducing weight, and the lower centrifugal distortion reducing weight being balanced with one another such that the sixth, seventh, and eighth centrifugal forces contribute a zero net centrifugal force during rotation, the upper fluid-induced distortion reducing weight and the upper centrifugal distortion reducing weight are formed integrally as a single monolithic upper weight, the middle fluid-induced distortion reducing weight, the first balancing weight, and the middle centrifugal distortion reducing weight are formed integrally as a single monolithic middle weight, and the lower fluid-induced distortion reducing weight, the second balancing weight, and the lower centrifugal distortion reducing weight are formed as a single monolithic lower weight.

9. A scroll compressor, comprising a compression mechanism including a fixed scroll and a movable scroll engaged with each other to form a compression chamber configured to compress a fluid;

a crankshaft having a main shaft and an eccentric portion eccentrically disposed at one end of the main shaft and coupled to a back side of the movable scroll;

an upper bearing supporting an upper portion of the main shaft of the crankshaft;

a lower bearing supporting a lower portion of the main shaft of the crankshaft; and a drive motor having a stator and a rotor, the rotor being coupled to the main shaft of the crankshaft to rotate the movable scroll, the scroll compressor having a weight array including a fluid-induced distortion reducing weight, a balancing weight, and a centrifugal distortion reducing weight, the weight array being provided to at least one of the main shaft of the crankshaft and the rotor, the fluid-induced distortion reducing weight being arranged and configured to reduce distortion of the crankshaft in a direction of a fluid load generated in the compression chamber and applied to the eccentric portion during rotation, the fluid-induced distortion reducing weight including an upper fluid-induced distortion reducing weight disposed at an upper portion of the main shaft and having a center of gravity spaced from an axial center of the main shaft in a direction opposite to the direction of the fluid load, the upper fluid-induced distortion reducing weight being arranged to generate a first centrifugal force when the main shaft rotates, a middle fluid-induced distortion reducing weight disposed at a middle portion of the main shaft and having a center of gravity spaced from the axial center of the main shaft in a same direction as the direction of the fluid load, the middle fluid-induced distortion reducing weight being arranged to generate a second centrifugal force when the main shaft rotates, and a lower fluid-induced distortion reducing weight disposed at a lower portion of the main shaft and having a center of gravity spaced from the axial center of the main shaft in the direction opposite to the direction of the fluid load, the lower fluid-induced distortion reducing weight being arranged to generate a third centrifugal force when the main shaft rotates, the upper fluid-induced distortion reducing weight, the middle fluid-induced distortion reducing weight, and the lower fluid-induced distortion reducing weight being arranged and configured such that the first, second, and third centrifugal forces contribute a zero net centrifugal force during rotation, the balancing weight being arranged and configured to balance a centrifugal force of the movable scroll during rotation, the balancing weight including a first balancing weight having a center of gravity located opposite to the eccentric portion relative to the axial center of the main shaft, the first balancing weight being arranged to generate a fourth centrifugal force when the main shaft rotates, and a second balancing weight farther from the eccentric portion than the first balancing weight and having a center of gravity located on a same side as where the eccentric portion is positioned, relative to the axial center of the main shaft, the second balancing weight being arranged to generate a fifth centrifugal force when the main shaft rotates, the centrifugal distortion reducing weight being arranged to reduce distortion of the crankshaft caused by balancing the centrifugal force of the movable scroll with a centrifugal force of the balancing weight, the centrifugal distortion reducing weight including an upper centrifugal distortion reducing weight disposed at an upper portion of the main shaft and having a center of gravity located opposite to the eccentric portion relative to the axial center of the main shaft, the upper centrifugal distortion reducing weight being arranged to generate a sixth centrifugal force when the main shaft rotates, a middle centrifugal distortion reducing weight disposed at a middle portion of the main shaft and having a center of gravity located on the same side as where the eccentric portion is positioned, relative to the axial center of the main shaft, the middle centrifugal distortion reducing weight being arranged to generate a seventh centrifugal force when the main shaft rotates, and a lower centrifugal distortion reducing weight disposed at a lower portion of the main shaft and having a center of gravity located opposite to the eccentric portion relative to the axial center of the main shaft, the lower centrifugal distortion reducing weight being arranged to generate an eighth centrifugal force when the main shaft rotates, the upper centrifugal distortion reducing weight, the middle centrifugal distortion reducing weight, and the lower centrifugal distortion reducing weight being balanced with one another such that the sixth, seventh, and eighth centrifugal forces contribute a zero net centrifugal force during rotation, the upper fluid-induced distortion reducing weight, the first balancing weight, and the upper centrifugal distortion reducing weight are formed integrally as a single monolithic upper weight;

the middle fluid-induced distortion reducing weight and the middle centrifugal distortion reducing weight are formed integrally as a single monolithic middle weight; and the lower fluid-induced distortion reducing weight, the second balancing weight, and the lower centrifugal distortion reducing weight are formed as a single monolithic lower weight.

* * * * *